US008549711B2

(12) United States Patent
Apostoloff

(10) Patent No.: US 8,549,711 B2
(45) Date of Patent: Oct. 8, 2013

(54) HINGE MOUNTED CHECK STRAP AND METHOD OF LIMITING OPENING MOVEMENT OF A HINGED DOOR

(75) Inventor: David Apostoloff, Derry, NH (US)

(73) Assignees: David Apostoloff, Derry, NH (US); James D. Titus, Salem, NH (US)

( * ) Notice: Subject to any disclaimer, the term of this patent is extended or adjusted under 35 U.S.C. 154(b) by 0 days.

(21) Appl. No.: 13/404,472

(22) Filed: Feb. 24, 2012

(65) Prior Publication Data

US 2013/0219665 A1 Aug. 29, 2013

(51) Int. Cl.
*E05F 5/02* (2006.01)
*E05D 11/06* (2006.01)

(52) U.S. Cl.
USPC ..... 16/375; 16/82; 16/86 C; 16/374; 16/319; 16/333

(58) Field of Classification Search
USPC ..... 292/338, 330, 339, 342, DIG. 15, 292/DIG. 19, DIG. 17; 296/146.11, 146.12, 296/146.4
See application file for complete search history.

(56) References Cited

U.S. PATENT DOCUMENTS

| | | | | | |
|---|---|---|---|---|---|
| 1,472,531 | A | * | 10/1923 | Morris | 16/82 |
| 1,481,742 | A | * | 1/1924 | Riley | 16/374 |
| 1,543,912 | A | * | 6/1925 | Gammeter | 16/82 |
| 1,607,897 | A | * | 11/1926 | Koons | 16/333 |
| 1,608,554 | A | | 11/1926 | Goldsmith et al. | |
| 1,646,580 | A | * | 10/1927 | Eastman | 16/82 |
| 1,757,075 | A | * | 5/1930 | Earhart | 16/371 |
| 1,757,261 | A | * | 5/1930 | Simmons | 16/82 |
| 1,775,789 | A | * | 9/1930 | Taffe | 16/322 |
| 1,819,212 | A | * | 8/1931 | Toncray | 16/82 |
| 1,837,517 | A | | 12/1931 | Ball | |
| 2,550,626 | A | * | 4/1951 | Vollmer | 292/275 |
| 3,157,906 | A | | 11/1964 | Wolf | |

(Continued)

FOREIGN PATENT DOCUMENTS

| | | | |
|---|---|---|---|
| CH | 651887 AS | * | 10/1985 |
| DE | 3623603 A1 | * | 1/1988 |
| DE | 20118595 U1 | * | 3/2003 |
| GB | 2382105 A | | 5/2003 |

OTHER PUBLICATIONS

Gregmporter, Karmann Ghia—Hinges and Check Straps. YouTube. Nov. 3, 2011 [retreived on May 7, 2013]. Retreived from the Internet: <URL:http://www.youtube.com/watch?v=GizDG7zfuil>.

(Continued)

*Primary Examiner* — Chuck Mah
(74) *Attorney, Agent, or Firm* — Lano & Anastasi, LLP

(57) ABSTRACT

A hinge assembly for a door assembly includes a hinge having a first plate attached to a door and a second plate attached to a door jamb and pivotally connected to the first plate. The hinge assembly further includes a check strap having a first end portion configured to be attached to the first plate, a second end portion configured to be attached to the second plate, and a strip secured to the first end portion and to the second end portion. The strip has a length that is selected to limit opening movement of the door to a predetermined angle of opening. The hinge assembly further includes fasteners to secure the first end portion of the check strap and the first plate to the door and the second end portion of the check strap and the second plate to the door jamb.

13 Claims, 5 Drawing Sheets

(56) References Cited

U.S. PATENT DOCUMENTS

| | | | | | |
|---|---|---|---|---|---|
| 3,325,854 | A | | 6/1967 | Steigerwald | |
| 3,602,942 | A | | 9/1971 | Neff, Sr. et al. | |
| 3,913,171 | A | | 10/1975 | Reid | |
| 4,070,727 | A | * | 1/1978 | Kanou | 16/72 |
| 4,301,570 | A | * | 11/1981 | Thomas | 16/85 |
| 4,648,152 | A | | 3/1987 | Grewall | |
| 4,663,801 | A | * | 5/1987 | Malopolski, Jr. | 16/82 |
| 4,799,721 | A | * | 1/1989 | Hale | 294/219 |
| 5,467,507 | A | | 11/1995 | Marsh et al. | |
| 6,149,212 | A | | 11/2000 | Kuntz et al. | |
| 6,220,562 | B1 | | 4/2001 | Konkle | |
| 6,311,367 | B1 | * | 11/2001 | Larsen | 16/375 |
| 6,345,416 | B1 | * | 2/2002 | Vollmar | 16/413 |
| 6,353,967 | B1 | | 3/2002 | Escobar et al. | |
| 7,559,114 | B2 | | 7/2009 | Ranilovich | |
| 7,904,992 | B2 | | 3/2011 | Agster et al. | |
| 2001/0024591 | A1 | | 9/2001 | Tani | |
| 2010/0269302 | A1 | | 10/2010 | Jagannathan | |

OTHER PUBLICATIONS

Notification of Transmittal of the International Search Report and the Written Opinion of the International Searching Authority from corresponding PCT/US2013/027224 mailed May 23, 2013.

* cited by examiner

HINGE MOUNTED CHECK STRAP AND METHOD OF LIMITING OPENING MOVEMENT OF A HINGED DOOR

BACKGROUND

1. Field of the Disclosure

The present disclosure relates generally to door checks and stops. More specifically, embodiments of this disclosure relate to systems and methods for limiting opening movement of a hinged door.

2. Description of Background

It is often desired to limit the opening movement of a hinged closure, and more particularly a hinged door. For example, limiting the swinging movement of a hinged door in the opening direction may be desirable to prevent the door from hitting a wall or furniture items located behind the door. While several types of door checks and stops have been employed, such known door checks and stops often require the installation of specialized hinges, thereby increasing cost and installation effort. Furthermore, door checks and stops often include moving parts or visible structures that are not aesthetically pleasing. In certain types of settings, such as homes or hotels, the use of bulky parts or structures visibly protruding from doors may be undesirable.

SUMMARY OF DISCLOSURE

Aspects and embodiments are directed to providing check straps that do not include bulky parts or protruding structures. The check strap can be easily installed on a standard hinge which is typically used for a swinging door, to limit the opening movement of the door. Aspects of the disclosure are also directed to providing check strap assemblies having the same benefits, and to providing convenient methods of limiting the opening movement of a hinged door.

An aspect of the disclosure is directed to a hinge assembly for a door assembly including a door and a door jamb. The hinge assembly comprises a hinge having a first plate attached to the door and a second plate attached to the door jamb and pivotally connected to the first plate. In a closed position of the door, there is a space between the first plate and the second plate. The hinge assembly further comprises a check strap configured to limit opening movement of the door. The check strap includes a first end portion configured to be attached to the first plate, a second end portion configured to be attached to the second plate, and a strip secured to the first end portion and to the second end portion. In some embodiments, the strip is meshed to permit folding. The strip has a length in a fully extended state. The length may be selected to limit opening movement of the door to a predetermined angle of opening. In one example, the length may be selected to limit opening of the door to an angle of approximately 90 degrees. In some embodiments, the hinge assembly may further include at least two fasteners to secure the first end portion of the check strap and the first plate to the door and the second end portion of the check strap and the second plate to the door jamb. In some embodiments, at least one fastener has a length selected such that the fastener extends at least partially through a framing stud disposed behind the door jamb.

In some embodiments, the strip has a thickness in a folded state, the thickness being less than the space between the first plate and the second plate of the hinge. The thickness may be selected to permit closing the door and to conceal the strip between the first plate and the second plate in the closed position of the door. In some embodiments, the strip may be concealed between the door and the door jamb. In some embodiment, each of the first end portion, the second end portion and the strip is made of a metal. In other embodiments, each of the first end portion, the second end portion and the strip may be made of any suitable material.

In embodiments of the hinge assembly, the first end portion may include a first opening and the second end portion may include a second opening. The first opening may be circular and may have a diameter sized to prevent a translational movement of the first end portion relative to the first plate. Furthermore, the second opening may be circular and have a diameter sized to prevent a translational movement of the second end portion relative to the second plate. The first end portion and the second end portion may be attached to the first plate and the second plate at a same height along a length of the first plate and along a length of the second plate.

Another aspect of the disclosure is directed to a method of limiting opening movement of a door of the type swinging around a hinge. The hinge has a first plate attached to the door and a second plate attached to a door jamb. In some embodiments, the method comprises providing a check strap having a first end portion, a second end portion and a flexible strip disposed between the first end portion and the second end portion, and selecting a length of the strip in a fully extended state so as to limit opening movement of the door. In one example, the length may be selected to limit opening the door to an angle of approximately 90 degrees. The method may further comprise attaching the first end portion to the first plate of the hinge and attaching the second end portion to the second plate of the hinge. In one example, the check strap may be made of metal. In some embodiments, the method may further comprise configuring the strip to be meshed to permit folding the strip and selecting a thickness of the strip in a folded state to be less than a space between the first plate and the second plate in a closed position of the door. The method may include extending the strip to the length to limit opening movement of the door. The method may further include concealing the strip in the folded state between the first plate and the second plate in the closed position of the door.

In some embodiments, the method may include selecting a first maximum thickness of the first end portion above the first plate to be less than the space between the first plate and the second plate in the closed position of the door, and selecting a second maximum thickness of the second end portion above the second plate to be less than the space between the first plate and the second plate in the closed position of the door, to allow concealing each of the first end portion and the second end portion between the first plate and the second plate in the closed position of the door.

In some embodiments, the method may include attaching the first end portion of the check strap to the door using a first screw, and attaching the second end portion of the check strap to the door jamb using a second screw. Attaching the second end portion of the check strap using the second screw may further include selecting a length of the second screw such that the second screw extends at least partially through a framing stud disposed behind the door jamb. The first end portion and the second end portion of the check strap may be attached to the first plate and the second plate of the hinge respectively at a same height.

Still other aspects, embodiments, and advantages of these exemplary aspects and embodiments are discussed in detail below. Embodiments disclosed herein may be combined with other embodiments in any manner consistent with at least one of the principles disclosed herein, and references to "an embodiment," "some embodiments," "an alternate embodiment," "various embodiments," "one embodiment" or the like are not necessarily mutually exclusive and are intended to indicate that a particular feature, structure, or characteristic described may be included in at least one embodiment. The appearances of such terms herein are not necessarily all referring to the same embodiment.

BRIEF DESCRIPTION OF THE DRAWINGS

Various aspects of at least one embodiment are discussed below with reference to the accompanying figures, which are not intended to be drawn to scale. The figures are included to provide illustration and a further understanding of the various aspects and embodiments, and are incorporated in and constitute a part of this specification, but are not intended as a definition of the limits of the disclosure. In the figures, each identical or nearly identical component that is illustrated in various figures is represented by a like numeral. For purposes of clarity, not every component may be labeled in every figure. In the figures.

DETAILED DESCRIPTION

It is to be appreciated that embodiments of the methods and apparatuses discussed herein are not limited in application to the details of construction and the arrangement of components set forth in the following description or illustrated in the accompanying drawings. The methods and apparatuses are capable of implementation in other embodiments and of being practiced or of being carried out in various ways. Examples of specific implementations are provided herein for illustrative purposes only and are not intended to be limiting. In particular, acts, elements and features discussed in connection with any one or more embodiments are not intended to be excluded from a similar role in any other embodiment.

Also, the phraseology and terminology used herein is for the purpose of description and should not be regarded as limiting. Any references to embodiments or elements or acts of the systems and methods herein referred to in the singular may also embrace embodiments including a plurality of these elements, and any references in plural to any embodiment or element or act herein may also embrace embodiments including only a single element. The use herein of "including," "comprising," "having," "containing," "involving," and variations thereof is meant to encompass the items listed thereafter and equivalents thereof as well as additional items. References to "or" may be construed as inclusive so that any terms described using "or" may indicate any of a single, more than one, and all of the described terms. Any references to front and back, left and right, top and bottom, upper and lower, and vertical and horizontal are intended for convenience of description, not to limit the present systems and methods or their components to any one positional or spatial orientation.

Figure 1:
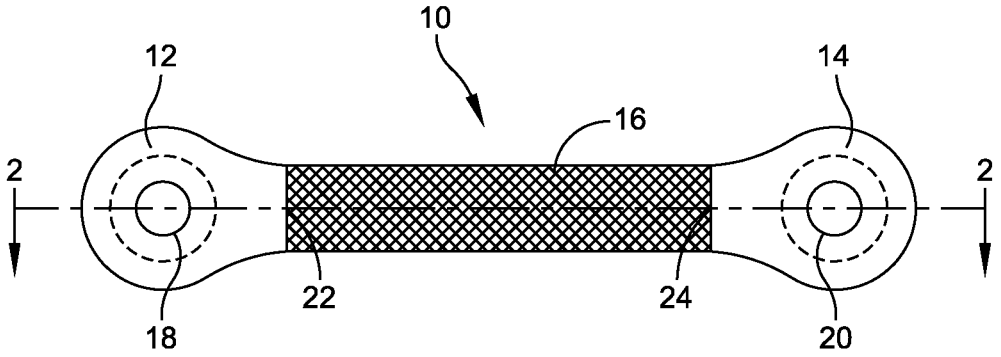
FIG. 1 is a top view of an exemplary embodiment of a check strap according to aspects of the present disclosure.

Turning now to the drawings, and more particularly to FIG. 1, there is shown an example of a check strap, generally indicated at 10, according to aspects of the disclosure. The check strap 10 includes a first end portion 12, and a second opposite end portion 14. The check strap 10 further includes a strip 16 disposed between the first end portion 12 and the second end portion 14. In one embodiment, the strip 16 is fabricated from wire mesh fabric material to permit folding and to provide structural reinforcement. In other embodiments, the strip 16 may be fabricated from any other suitable material. Each of the first end portion 12 and the second end portion 14 is made from a metal. However, each of the first end portion 12 and the second end portion 14 may be made from any other suitable material. As shown in FIG. 1, the first end portion 12 is in the form of an eyelet and includes a first opening 18 configured to receive a first attaching device. Similarly, the second end portion 14 is in the form of an eyelet and includes a second opening 20 configured to receive a second attaching device. In one example, each of the first and second attaching devices may be a screw. In one embodiment, each of the openings 18 and 20 may be circular, as shown in FIG. 1. Each of the circular openings 18 and 20 may have a diameter selected to limit translational movement of the first end portion 12 and the second end portion 14 upon attachment to respective surfaces, such as plates of a hinge, by their respective attaching devices. In other embodiments, the openings 18 and 20 may have other shapes configured to prevent translational movement of the first end portion 12 and the second end portion 14. In one embodiment, the first end portion 12 may have a round shape including a flat portion with one end of the flat portion having a first edge 22 forming an interface with one end of the strip 16, as shown in FIG. 1, to connect the end of the strip to the first end portion. Similarly, the second end portion 14 may have a round shape including a flat portion, with one end of the flat portion having a second edge 24 forming an interface with an opposite end of the strip 16, to connect the opposite end of the strip to the second end portion. In other embodiments, the first end portion 12 and the second end portion 14 may have other shapes or distinct shapes, and may include a plurality of openings or slots. In one embodiment, each of the first end portion 12, the second end portion 14 and the strip 16 may be made from a suitable metal. In other embodiments, each of the first end portion 12, the second end portion 14 and the strip 16 may be made from any other suitable material. An interface between the strip 16 and each of the first end portion 12 and the second end portion 14 to securely affix the strip to the first end portion may be constructed by applying any suitable method. In some embodiments, the interfaces may be constructed by one of crimping, welding, soldering and providing a unitary plastic.

Figure 2:
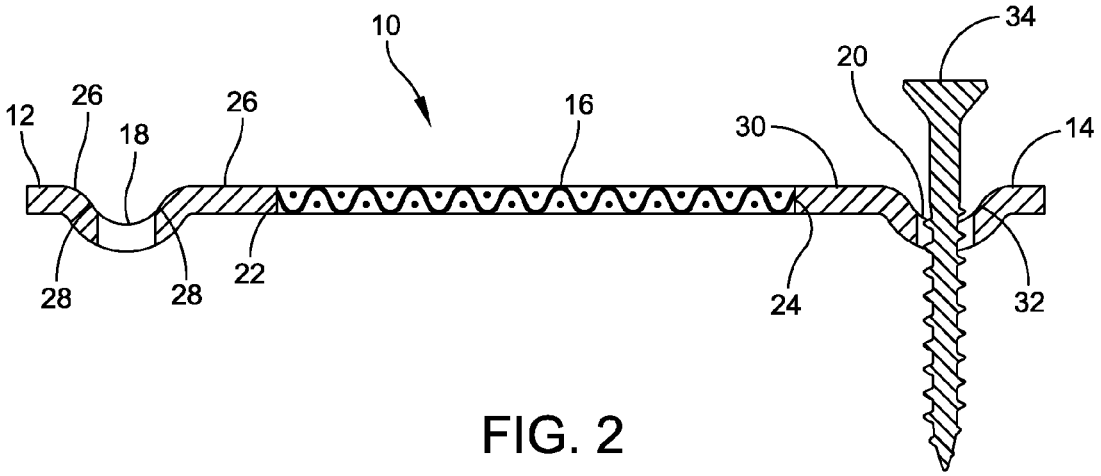
FIG. 2 is a cross-sectional view of the check strap along line 2-2 in FIG. 1.

FIG. 2 illustrates a cross-sectional view of the check strap 10 along line 2-2 in FIG. 1. The first end portion 12 has a flat surface portion 26 and a tapered edge portion 28 forming a dimple around the first opening 18. Similarly, the second end portion 14 has a flat surface portion 30 and a tapered edge portion 32 forming a dimple around the second opening 20. A screw 34 is shown inserted through the second opening 20 of the second end portion 14. The screw 34 may be a standard wood screw used in conjunction with a standard hinge. The first opening 18 of the first end portion 12 is also configured to receive a fastener (such as screw 36 shown in FIG. 3).

Figure 3:
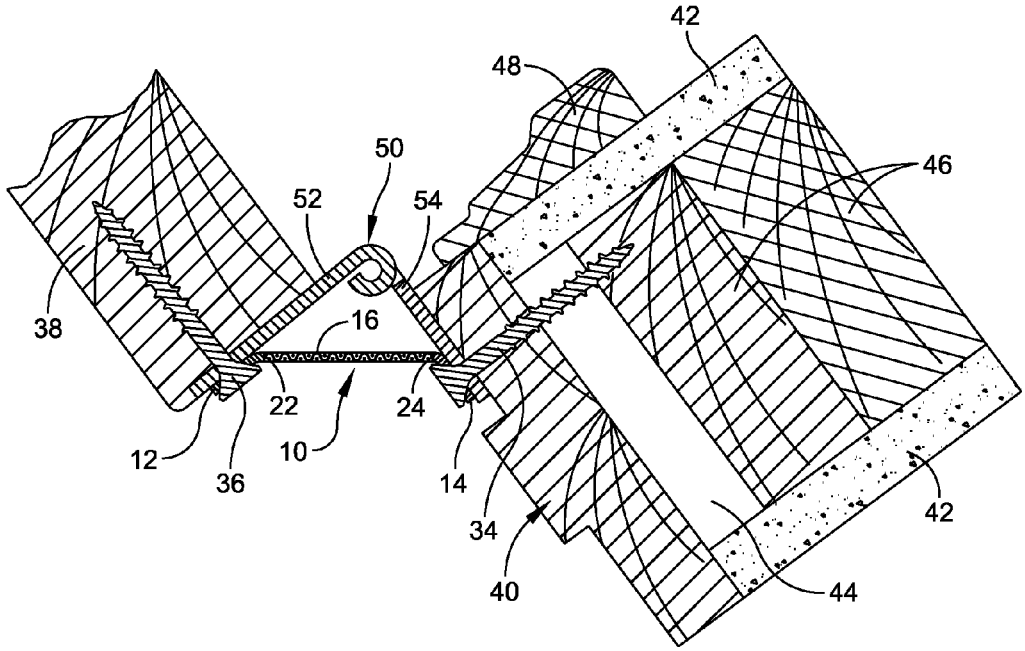
FIG. 3 is a cross-sectional view of a door assembly including the check strap of FIG. 1 attached to a door hinge and extended to limit the opening movement of the door according to aspects of the present disclosure.

FIG. 3 illustrates the check strap 10 being attached to a hinge of a swinging door assembly, generally indicated at 37. The door assembly 37 includes a door 38 and a door jamb, generally indicated at 40. Each end of the door jamb 40 may be disposed against a layer of sheetrock 42 as shown in FIG. 3. There may be an open space 44 disposed behind the door jamb 40, and one or more framing studs 46 disposed behind the open space 44. The open space 44 and the one or more framing studs 46 are contained between the layers of sheetrock 42. The door assembly 37 may also have a trim 48.

The door assembly 37 includes a hinge generally indicated at 50. The hinge 50 includes a first plate 52 attached to the door 38 and a second plate 54 attached to the door jamb 40. The hinge 50 may be a standard hinge, and the plates 52 and 54 may be attached to the door 38 and the door jamb 40, respectively, by standard screws, such as wood screws 34 and 36 shown in FIG. 3. A check strap 10 made according to aspects disclosed herein may be attached to the hinge 50 using the same screws that attach plates 52 and 54 to the door 38 and the door jamb 40, respectively.

In FIG. 3, the first end portion 12 of the check strap 10 is attached to the first plate 52 by the screw 36, with the first plate being between the door 38 and the first end portion. The second end portion 14 of the check strap 10 is attached to the second plate 54 by the screw 36, with the second plate being between the door jamb 40 and the second end portion. The second screw 36 extends at least partially through one of the framing studs 46 disposed behind the door jamb 40 and the open space 44. In embodiments disclosed herein, each of the first end portion 12 and the second end portion 14 of the check strap 10 may be attached respectively to the first plate 52 and the second plate 54 of the hinge 50 to prevent a translational movement of the first and second end portions with respect to the door 38 and the door jamb 40, respectively. Furthermore, each of the end portions 12 and 14 may be attached in an orientation selected to prevent twisting of the strip 16. The end portions 12 and 14 may have attachment locations having a same height on the first plate 52 and the second plate 54. The attachment locations may be selected to be symmetrically positioned on the first plate 52 and the second plate 54.

Figure 4:
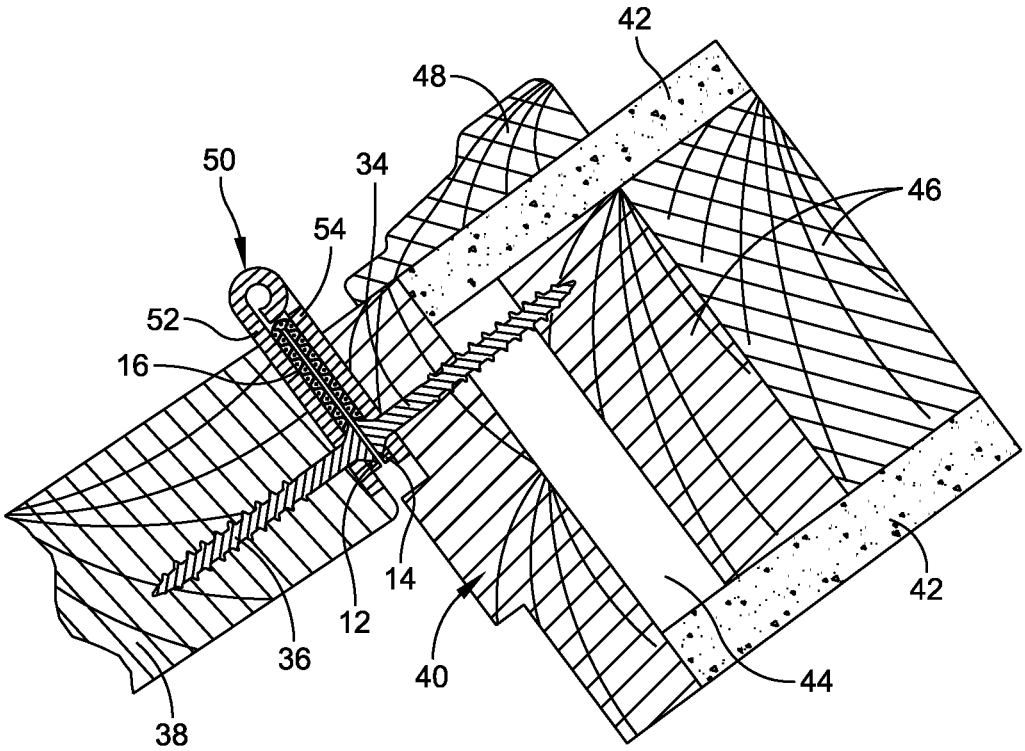
FIG. 4 is a cross-sectional view of the door assembly of FIG. 4 when the door is closed, further illustrating one example of a folded state of the check strap according to aspects of the present disclosure.

In a fully extended state as shown in FIG. 3, the strip 16 of the check strap 10 has a length selected to limit the outward or opening movement of the hinged door 38 when each of the first end portion 12 and the second end portion 14 is attached to a respective plate 52, 54 of the hinge 50. In one embodiment, the length of the strip 16 of the check strap 10 is selected to limit the opening of the door 38 to approximately 90 degrees. In another embodiment, the length of the strip 16 of the check strap 10 is selected to limit the opening of the door 38 to less than 90 degrees. The meshed or braided strip 16 is configured to permit folding of the check strap 10 as the door 38 closes. FIG. 4 shows the door assembly 37 of FIG. 3 with the door 38 being closed. In the closed position, the first plate 52 and the second plate 54 are separated by a small distance. The strip 16 is shown to be folded and disposed between the first plate 52 and the second plate 54 such that the strip is concealed between the plates when the door 38 is closed. In the folded state, the strip 16 has a thickness that is less than the distance between the first plate 52 and the second plate 54, thereby allowing the folded strip to fit between them. Rotational positions of each of the end portions 12 and 14 of the check strap 10 may dictate the orientation of each of the edges 22 and 24 of the respective end portions, thereby guiding a direction of folding of the strip 16 upon closing door 38. In embodiments disclosed herein, the strip 16 may fold in different patterns. For example, the strip 16 may fold along a generally horizontal plane towards the intersection of the plates 52 and 54 as shown in FIG. 4. In other examples, the strip 16 may fold along a generally horizontal plane in a direction away from the intersection of the plates 52 and 54, or along a generally vertical plane that is parallel to the intersection of the plates 52 and 54. Furthermore, as shown in FIG. 4, the first end portion 12 and the second end portion 14 each has a maximum thickness that fits within the distance between the plates 52 and 54. When the end portions 12 and 14 are symmetrically positioned, a sum of their respective maximum thicknesses above the respective plates 52 and 54 is less than a distance between the first plate and the second plate in the closed position of the door. In some embodiments, the end portions may have maximum thicknesses of approximately zero relative to the plates 52, 54 in that the end portions are recessed within the plates.

Aspects of the disclosure are also directed to methods of limiting opening movement of the door 38. In one example, the method includes providing a check strap 10 having a first end portion 12, a second end portion 14 and a strip 16 disposed between the first end portion and the second end portion as described herein; configuring the strip 16 to be fabricated from a meshed material to permit folding the strip while providing structural reinforcement; selecting a length of the strip 16 in a fully extended state so as to limit opening movement of the door 38; and selecting a thickness of a folded state of the strip 16 to be less than a distance between the first plate 52 and the second plate 54 in a closed position of the door 38. The method further includes attaching the first end portion 12 to the first plate 52 of the hinge 50 and attaching the second end portion 14 to the second plate 54 of the hinge; extending the strip 16 to the length to limit opening movement of the door 38, and concealing the strip between the first plate 52 and the second plate 54 in the closed position of the door. The method may include concealing the strip between the door 38 and the door jamb 40 in the closed position of the door.

Figure 5:
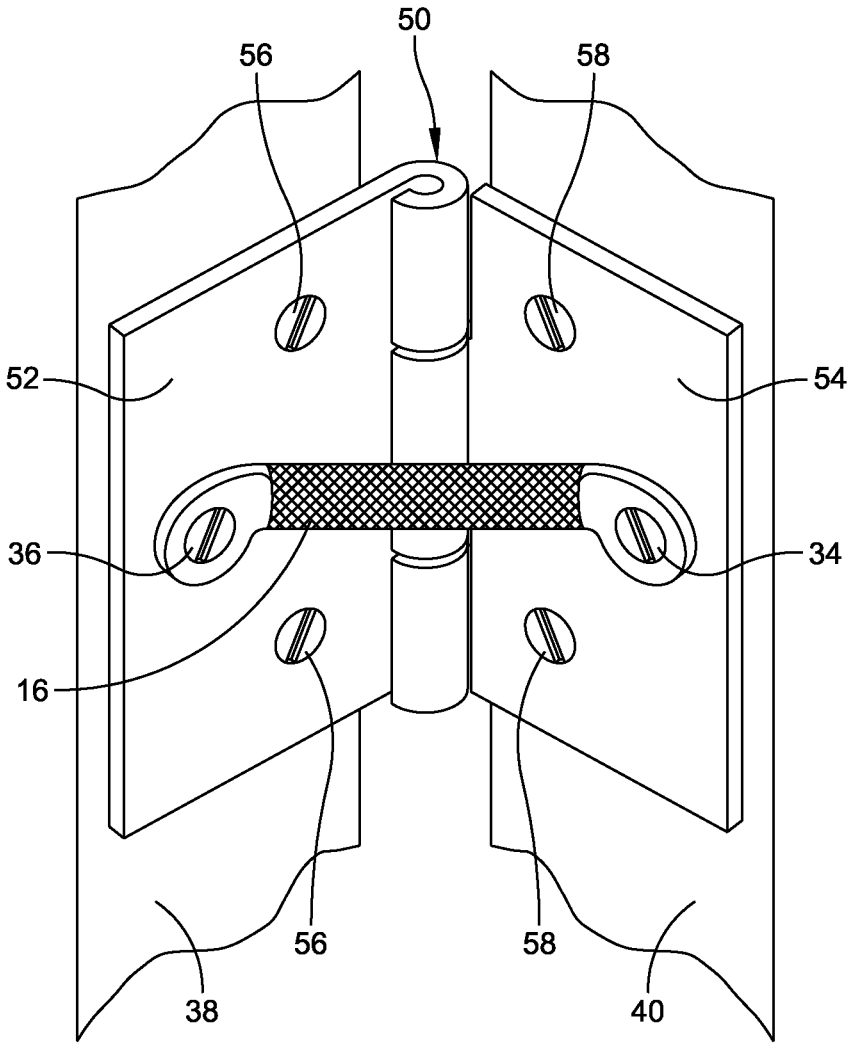
FIG. 5 is a perspective view of an exemplary embodiment of a door hinge assembly including a check strap according to aspects of the present disclosure.

In one embodiment, the method may include removing screws 34, 36 (for example, the offset middle screws associated with hinge 50), and securing the check strap 10 with the screws. In a particular embodiment, screw 34 may be longer than screw 36 so that the screw 34 reaches and bites into stud 46. FIG. 5 shows a perspective view of a door 38 and door jamb 40 coupled by a hinge 50. Check strap 10 is extended to limit the opening angle of the door 38 relative to the door jamb 40. The hinge 50 has a first plate 52 attached to the door 38 using a plurality of screws 56. The hinge 50 also has a second plate 54 attached to the door jamb 40 using a plurality of screws 58. The screws 58 include a middle screw which is offset relative to the other screws. In one embodiment, one of the screws 58, e.g. the offset middle screw, may be removed and replaced by a longer screw 34, which is designed to screw into stud 46 (as shown in FIG. 4). In FIG. 5, the first end portion and the second end portion of the check strap 10 are secured at the location of the offset middle screw 36 and the location of the offset middle screw 34, respectively.

Having described above several aspects of at least one embodiment, it is to be appreciated various alterations, modifications, and improvements will readily occur to those skilled in the art. Such alterations, modifications, and improvements are intended to be part of this disclosure and are intended to be within the scope of the disclosure. Accordingly, the foregoing description and drawings are by way of example only, and the scope of the disclosure should be determined from proper construction of the appended claims, and their equivalents.

What is claimed is:

1. A hinge assembly for a door assembly including a door and a door jamb, the hinge assembly comprising:

a hinge having a first plate attached to the door and a second plate attached to the door jamb and pivotally connected to the first plate, the first plate and the second plate having a space therebetween in a closed position of the door;

a check strap configured to limit opening movement of the door, the check strap including a first end portion configured to be attached to the first plate, a second end portion configured to be attached to the second plate, and a strip secured to the first end portion and to the second end portion, the strip being meshed to permit folding, the strip having a length in a fully extended state, the length being selected to limit opening movement of the door to a predetermined angle of opening; and at least two fasteners to secure the first end portion of the check strap and the first plate to the door and the second end portion of the check strap and the second plate to the door jamb, wherein at least one of the fasteners has a length selected such that the fastener extends at least partially through a framing stud disposed behind the door jamb.

2. The assembly of claim 1, the strip having a thickness in a folded state, the thickness being less than the space between the first plate and the second plate so as to permit closing the door and to conceal the strip between the first plate and the second plate in the closed position of the door.

3. The assembly of claim 1, wherein the first end portion includes a first opening and the second end portion includes a second opening.

4. The assembly of claim 3, wherein the first opening is circular and has a diameter sized to prevent a translational movement of the first end portion relative to the first plate, and wherein the second opening is circular and has a diameter sized to prevent a translational movement of the second end portion relative to the second plate.

5. The assembly of claim 1, wherein the first end portion and the second end portion are attached respectively to the first plate and the second plate at a same height along a length of the first plate and along a length of the second plate.

6. The assembly of claim 1, wherein each of the first end portion, the second end portion and the strip is made of a metal.

7. A method of limiting opening movement of a door of the type swinging around a hinge, the hinge having a first plate attached to the door and a second plate attached to a door jamb, the method comprising:

providing a check strap having a first end portion, a second end portion and a flexible strip disposed between the first end portion and the second end portion;

selecting a length of the strip in a fully extended state so as to limit opening movement of the door;

attaching the first end portion to the first plate of the hinge; and attaching the second end portion to the second plate of the hinge, wherein attaching the first end portion further includes attaching the first end portion of the check strap using a first screw, and attaching the second end portion further includes attaching the second end portion of the check strap using a second screw, wherein attaching the second end portion of the check strap using the second screw further includes selecting a length of the second screw such that the second screw extends at least partially through a framing stud disposed behind the door jamb.

8. The method of claim 7, wherein the strip is selected from a meshed strip to permit folding of the strip.

9. The method of claim 7, the strip has a thickness so that the strip, when in a folded state, is less than a space between the first plate and the second plate in a closed position of the door.

10. The method of claim 9, further including:

extending the strip to the length to limit opening movement of the door; and concealing the strip in the folded state between the first plate and the second plate in the closed position of the door.

11. The method of claim 9, further including:

selecting a first maximum thickness of the first end portion above the first plate to be less than the space between the first plate and the second plate in the closed position of the door;

selecting a second maximum thickness of the second end portion above the second plate to be less than the space between the first plate and the second plate in the closed position of the door; and concealing each of the first end portion and the second end portion between the first plate and the second plate in the closed position of the door.

12. The method of claim 7, further including attaching the first end portion of the check strap and the second end portion of the check strap to the first plate and the second plate respectively at a same height.

13. The method of claim 7, wherein providing a check strap further includes providing a check strap made of metal.

* * * * *